United States Patent [19]

Muys

[11] 4,375,886

[45] Mar. 8, 1983

[54] JUMP ROPE

[75] Inventor: Louis G. Muys, Elgin, Ill.

[73] Assignee: Strombecker Corporation, Chicago, Ill.

[21] Appl. No.: 218,255

[22] Filed: Dec. 19, 1980

[51] Int. Cl.[3] ..... A63B 5/20

[52] U.S. Cl. ..... 272/75

[58] Field of Search ..... 272/75, 77, 133, 142, 272/DIG. 4; 46/1 G, 61, 62, 77; 273/26 E; 24/115 R, 115 G, 115 M, 115 H, 115 A, 115 K, 115 L; 403/164, 165, 361, 333, 334; 16/202, 205, 207, 108, 110 R; 308/174, 175, 176, 237 R, DIG. 3, DIG. 4

[56] References Cited

U.S. PATENT DOCUMENTS

| | | | |
|---|---|---|---|
| 399,216 | 3/1889 | Spencer | 16/202 |
| 1,436,703 | 11/1922 | Fisher | 272/75 |
| 2,869,872 | 1/1959 | Nissen | 272/75 |
| 3,120,023 | 2/1964 | Ustin | 16/108 |
| 3,778,053 | 11/1973 | Smith et al. | 272/75 |
| 4,293,125 | 10/1981 | Hinds | 272/75 |

FOREIGN PATENT DOCUMENTS

| | | | |
|---|---|---|---|
| 553528 | 2/1923 | France | 272/75 |
| 774369 | 9/1934 | France | 272/75 |
| 775764 | 10/1934 | France | 272/75 |
| 1507343 | 11/1967 | France | 272/75 |
| 328469 | 3/1958 | Switzerland | 272/75 |
| 667 | of 1889 | United Kingdom | 272/75 |
| 6467 | of 1909 | United Kingdom | 272/75 |
| 185615 | 9/1922 | United Kingdom | 272/75 |

*Primary Examiner*—Richard C. Pinkham
*Assistant Examiner*—Arnold W. Kramer
*Attorney, Agent, or Firm*—Allegretti, Newitt, Witcoff & McAndrews, Ltd.

[57] ABSTRACT

A jump rope assembly comprising a rope fixedly secured at each end to a tubular member that is journalled for rotation in a handle. The tubular members are secured to the ends of the rope without any separate fastening means. This attachment of the rope end to a tubular member is accomplished by bending the end of the rope upon itself and forcing it into a tubular member, and then pulling the rope end to fix the rope end to the tubular member. In use, each tubular member can rotate within its associated handle.

7 Claims, 5 Drawing Figures

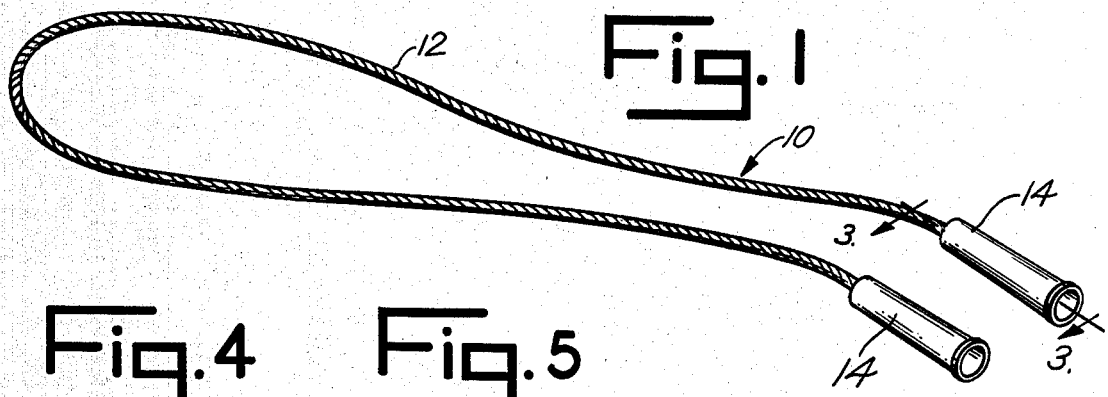
Fig. 1
Fig. 4
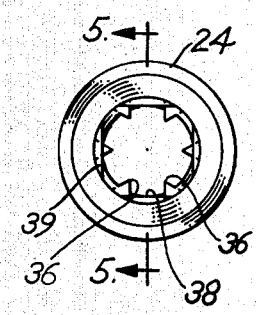
Fig. 5
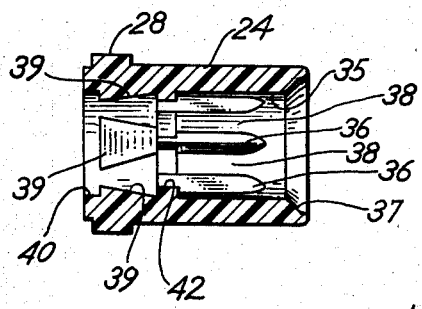
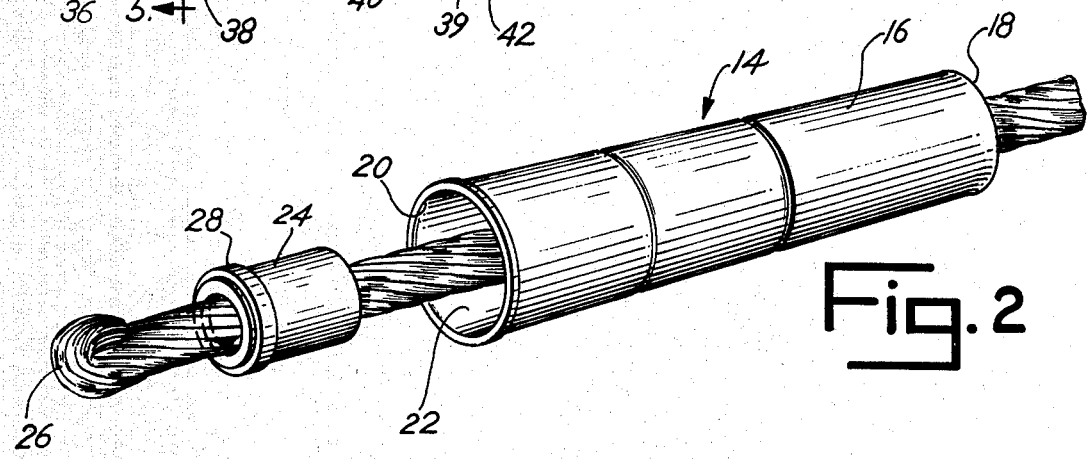
Fig. 2
Fig. 3
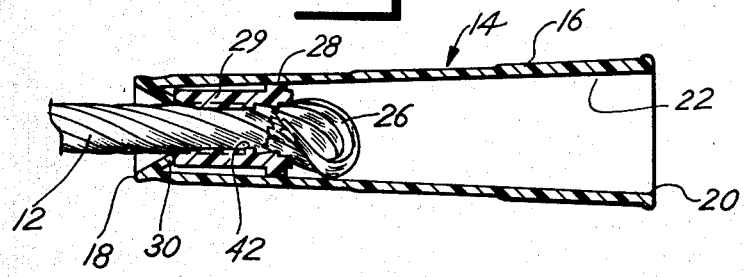

JUMP ROPE

BACKGROUND OF THE INVENTION

This invention relates to a jump rope assembly and more particularly, to an improved jump rope assembly having novel means for securing the rope ends to tubular members within the handles in a simple, inexpensive way, without separate fastening means. The novel jump rope assembly permits the tubular members to rotate within the handles, and thereby facilitate use of the jump rope assembly.

In the past, there has been shown in the prior art known to the applicant various means for securing a rope to a handle in a jump rope assembly. In the Fisher U.S. Pat. No. 1,436,703, a rope is passed through a ball and the end of the rope is then knotted. The ball and rope end are placed within a substantially egg-shaped recess in each half of a wooden handle and the two halves of the wooden handle are then glued or otherwise secured together. The rope handle construction shown in the Fisher patent is considered costly, unreliable and undesirable today.

The Johnson U.S. Pat. No. 2,253,075 suggests securing one end of a jump rope permanently to a handle by means including a washer and the other end is secured to a eye that is affixed to a handle of a jump rope.

Another method of securing a rope to a handle as shown in Nissan patent 2,869,872, is to provide a special cap having a loop. The cap can be pried or accidentally loosened or removed from the handle with the result that the rope would fall from the handle. Further, the rope is not journalled in the handle and use of the jump rope assembly is made more difficult and unreliable.

An object of the present invention is to provide an improved jump rope assembly which overcomes the disadvantages and deficiencies in prior constructions.

Another object of the present invention is to provide an improved jump rope assembly including a tubular member journalled for rotation in each handle and a rope passing through the opening in the tubular member and being bent upon itself and drawn into the opening in the tubular member so as to secure the rope in the tubular member, whereby, in use each tubular member can rotate within its associated handle.

Other objects and advantages of the present invention will become more apparant hereinafter.

BRIEF DESCRIPTION OF THE DRAWING

There is shown in the attached drawing a presently preferred embodiment of the present invention wherein:

FIG. 1 is a perspective view of a jump rope embodying the present invention;

FIG. 2 is a partial exploded view of the jump rope, illustrating how a rope end is secured within the associated handle assembly;

FIG. 3 is a detail cross-sectional view taken generally along line 3—3 of FIG. 1;

FIG. 4 is an end view of a tubular member of the handle assembly; and

FIG. 5 is a cross-sectional view of a tubular member taken generally along the line 5—5 of FIG. 4.

DETAILED DESCRIPTION OF THE PRESENT INVENTION

With reference to FIG. 1, there is illustrated a jump rope assembly 10 comprising an elongated rope 12 with a handle 14 at each end. Since the handles are identical the same reference numeral will be used for each handle and the same reference numerals will be applied for common components thereof.

The rope 12 may be made of strands of cotton or a suitable plastic interwoven plastic or braided in a normal fashion. The ends of the rope 12 are adapted to be secured to the handles to provide for firm retention without separate fasteners and to provide for rotation of the rope with respect to each handle to facilitate use of the jump rope.

With reference to FIG. 2, there is shown the connection of one rope end to the handle 14. The handle 14 basically comprises a hollow housing 16 having a through opening or passage 22 tapering between a smaller end 18 and a larger end 20. The rope 12 extends through the passage 22 within the handle 16. The end 26 of the rope 12 is bent upon itself, inserted into the tubular member 24 and the rope 12 is pulled relative to the tubular member 24 to fixedly secure the rope end 26 in the tubular member 24.

The tubular member 24 is provided with an annular flange 28 of relatively narrow width or longitudinal extent to provide only a relatively small contact surface between the outer surface of the annular flange 28 and the surface of passage 22 in the handle 16. Such construction facilitates the rotation of the tubular members 24 with respect to the handle 16 when the jump rope assembly 10 is used.

Turning to FIG. 3, there is better shown the relationship of the annular flange 28 of the tubular member 24 to the passage 22 and handle 16. Normally, in use, the tubular member 24 is drawn to the left against the abutment shoulder 30 formed at the smaller end 18 of the handle 16. The abutment shoulder 30 is preferably annular and molded integral with the handle 16. The tubular member 24 is intended to contact the internal surface of the passage 22 in housing 16 only via the annular flange 28 so as to provide a relatively small contact region and thereby reduce the friction between the tubular member 24 and the handle 16. Preferably, the handle 16 and the tubular member 24 are molded from a suitable plastic, for example, polyproplene, which has good strength for the intended purpose as well as desirable bearing properties.

The detail of the tubular member 24 is shown in FIGS. 4 and 5. The tubular member 24 is provided with a through opening 35. Inwardly extending projections 36 defining recessed areas 38 are provided in the tubular member 24. Though six projections 36 are shown, the number can be varied. The configuration of projections 36 and recessed areas 38 help locate and orient the rope in the tubular member 24. The passage 35 has a counterbored openng 37 to facilitate entry of the end of the rope into the tubular member. Similarly, the ends of the projections 36 are streamlined to provide minimum interference with the rope to be passed through the tubular member 24. Also, provided in the tubular member 24 are a plurality of flat surface regions 39. The faces of these flat surface regions taper from the opening 40 to the internal annular flange 42, with a taper that increases from the opening 40 to the internal annular flange 42. This construction provides increased space within the tubular member 24 to accommodate the fibers or strands of the bent over end of the rope.

To secure the rope 12 to the tubular member 24, the end of rope is inserted into and through the tubular member 24. Entry of the rope into passage or opening 35 is facilitated by the counterbored opening 37. Projections 36 will help guide the rope through the internal flange 42. After the end of the rope is bent upon itself, the double thickness of rope is inserted through the opening 40 into passage 35. Then the rope is pulled to tighten the bent over end of the rope in the tubular member and effect a firm interconnection of the rope and the tubular member. No separate tools or fasteners are required.

Manufacture and assembly of the jump rope of the present invention is easy and relatively inexpensive. No special tools are required to affect the assembly of the components into a firmly assembled relationship, yet one which will permit easy rotation of the tubular member 24 relative to the handle 16. Thus, in use, the rope ends will be rotatable with respect to the handles. Recapitulating, the ends of the rope 12 are adapted to be secured to the handle assemblies 14 by being passed through the handle assemblies. The rope ends are bent over upon themselves and each is inserted into tubular member 24 and then pulled tight so as to form an integral bent end 26 which is tightly secured and retained within the tubular member 24 without any separate fasteners. The tubular member 24 is drawn within the handle housing 16 until it abuts the abutment shoulder 30. The jump rope assembly is now ready for use.

While I have shown a presently preferred embodiment of the present invention, it will be apparant that the invention may take such other forms as are embodied within the scope of the following claims.

What is claimed is:

1. In a jump rope assembly comprising a rope with a handle joined to each end of the rope, said handle having an internal passage therein and an internal abutment shoulder adjacent one end, a tubular member journaled for rotation in each handle, said tubular member having an annular flange on the exterior thereof adjacent one end that abuts the inner surface of the handle over only a relatively small contact surface to provide minimum friction between the tubular member and the handle, said tubular member having an opening therethrough, the rope being bent over upon itself and drawn into the opening in the tubular member to secure the rope fixedly to the tubular member without knotting the rope and without fasteners, the opening in the tubular member being tapered with a taper that increases from the entry opening into the tubular member to accommodate the bent over end of the rope, the end of the tubular member remote from the annular flange abutting the abutment shoulder, whereby in use, each said tubular member can rotate easily within its associated handle.

2. A jump rope assembly as in claim 1, wherein the opening in the tubular member is defined by a surface which is grooved.

3. A jump rope assembly as in claim 1 wherein the handle passage has a smaller size opening at one end and a larger size opening at the other end, and the tubular member is adapted to contact abutment means adjacent the smaller size opening to prevent it from passing through the smaller size opening.

4. A jump rope assembly as in claim 3 wherein the abutment means comprises an annular shoulder in said handle.

5. A jump rope assembly as in claim 4 wherein the handle is molded from plastic and the annular shoulder is formed integrally with the handle.

6. A jump rope assembly as in claim 1 wherein the handle internal passage is defined by a tapered surface and the annular flange on the tubular member abuts said tapered surface.

7. A handle assembly for a jump rope having a rope with a handle joined to each end of the rope, said handle having an internal passage therein, said handle having an internal abutment shoulder adjacent the inner end, a tubular member journaled for rotation in said handle, said tubular member having an annular flange on the exterior thereof adjacent one end that abuts the inner surface of the handle over only a relatively small contact surface to provide minimum friction between the tubular member and the handle, said tubular member having an opening therethrough, the rope being adapted to be fixed to the tubular member, the opening in the tubular member being tapered with a taper that increases from the entry opening adjacent the annular flange into the tubular member to accommodate the end of the rope, the end of the tubular member remote from the annular flange abutting the abutment shoulder, whereby in use, said tubular member can rotate easily within said handle.

* * * * *